United States Patent [19]

Murphy

[11] 4,048,057

[45] Sept. 13, 1977

[54] INTEGRATED HEAVY OIL CRACKING PROCESS UTILIZING CATALYST SEPARATED FROM CRACKING IN PRETREATING ZONE

[75] Inventor: James R. Murphy, Houston, Tex.

[73] Assignee: Pullman Incorporated, Chicago, Ill.

[21] Appl. No.: 729,528

[22] Filed: Oct. 4, 1976

[51] Int. Cl.[2] ..... C10G 23/00

[52] U.S. Cl. ..... 208/89; 208/251 H; 252/416

[58] Field of Search ..... 208/89, 57, 58

[56] References Cited

U.S. PATENT DOCUMENTS

| | | | |
|---|---|---|---|
| 2,376,086 | 5/1945 | Reid | 208/57 |
| 3,162,596 | 12/1964 | Anderson et al. | 208/89 |
| 3,265,613 | 8/1966 | Garwood | 208/89 |
| 3,686,093 | 8/1972 | Irvine | 208/89 |
| 3,781,197 | 12/1973 | Bryson et al. | 208/89 |
| 4,017,380 | 4/1977 | Byler et al. | 208/89 |

*Primary Examiner*—George Crasanakis
*Attorney, Agent, or Firm*—C. W. Crady; C. W. Walford

[57] ABSTRACT

An integrated process is described wherein a heavy oil catalytic cracking unit is integrated with a pretreating zone. In the pretreating zone, petroleum feedstock is contacted, in the presence of hydrogen, with used equilibrium catalyst purged from the cracking zone to reduce the metals, carbon residue, and sulfur content of the petroleum feedstock prior to charging the feedstock to the cracking zone of the heavy oil catalytic cracking unit.

17 Claims, 3 Drawing Figures

INTEGRATED HEAVY OIL CRACKING PROCESS UTILIZING CATALYST SEPARATED FROM CRACKING IN PRETREATING ZONE

BACKGROUND OF THE INVENTION

This invention relates to an improved process for catalytically cracking a petroleum feedstock, particularly petroleum feedstocks having high metals and carbon residue content. In the refining of crude petroleum to final petroleum products, petroleum fractions are often processed through a catalytic cracking process to increase the yield of distillates, gasoline, and other valuable marketable products.

In the catalytic cracking of petroleum feedstocks, the catalysts used are selected from natural catalyst, synthetic catalyst, and high activity catalyst containing zeolites, for example. These catalysts are well known to those in the refining art. When residual petroleum feeds are employed in the catalytic cracking process, carbon formers and metals, principally vanadium and nickel, deposit on the cracking catalyst, reducing the activity and selectivity of the catalyst for cracking petroleum to important useful products and causing further operational problems in the catalytic cracking unit itself.

The metal concentration on the catalyst can be allowed to build to a certain level at which point steps must be taken to reduce the amount of metals contamination on the catalyst. This can be accomplished in several ways, one of which comprises withdrawing a portion of the cracking catalyst from the unit and replacing it with fresh catalyst, thus reducing the overall metals content of the catalyst inventory. With a relatively modest upper limit of metal deposition allowable on the catalyst, i.e., approximately 1% total metals, petroleum feedstocks having high metals content would become very expensive to process in a catalytic cracking unit requiring large amounts of makeup catalyst and the consequential disposal of large quantities of equilibrium catalyst. Equilibrium catalyst is the catalyst in the cracking unit which is assumed to have attained its equilibrium properties of activity, selectivity, etc. through extended use at relatively constant conditions. At equilibrium, the metal content being removed as a deposit on the catalyst is equal to the metals being added in the feed. It has been found that generally a metals content of approximately 20 ppm in the petroleum feedstock results in satisfactory processing with only a modest replacement of catalyst at a tolerable level.

In view of the increasing demand for products of petroleum cracking, utilizing heavier petroleum charges for feedstock has become a necessity. Available feedstocks include petroleum crude oils and residuums or other fractions which are suitable feedstocks except for high metals or high carbon residue content. Such feedstocks can include oil fractions derived from coal, shale, or tar sands.

Much effort and attention has been devoted to removing the metals and reducing carbon residue from these petroleum feedstocks. For example, in U.S. Pat. No. 3,576,737, a method is taught whereby a petroleum residuum is contacted at a temperature between 600° F. and 900° F. and a hydrogen partial pressure between 100 and 3,000 psig with catalyst particles containing about 0.5 to 10 wt. % of vanadium and having a certain average pore diameter greater than 300 angstroms. The patentee goes to great lengths to describe other prior art efforts for removing metallic contaminants from petroleum residuum. U.S. Pat. No. 3,227,645 describes a method for removing metallic contaminants by contacting a residuum at a temperature of 350° F. to 800° F. and pressures of 200 to 3,000 psig with hydrogen in the presence of a sulfur resistant hydrogenation catalyst comprising one or more of the oxides or sulfides of the compounds of Group VI and/or Group VIII metals supported on a carrier, typically a refractory oxide support such as alumina.

Several modes of practicing such processes are also described in the prior art. For example, U.S. Pat. No. 2,689,825 describes the use of freshly ground fines of a catalyst charge removed from a fluid catalytic cracking unit to contact the feed prior to entry of the oil into the fluid catalytic cracker. The catalyst is said to absorb the metallic contaminants and move with the petroleum residuum through the cracker to be discarded prior to the regeneration of the main body of catalysts in the catalytic cracker. U.S. Pat. No. 3,893,911 describes the use of a fluid catalyst in an ebullating bed reactor to absorb the metals on an activated porous alumina oxide catalyst. This catalyst is characterized in that its activity is related to aging in the presence of vanadium to absorb some vanadium on the catalyst giving it higher activity for removal of the metallic contaminants. The catalyst described in U.S. Pat. No. 3,893,911 is regenerated by the burning of carbon from its surface and returning the catalyst to the reaction zone. U.S. Pat. No. 3,876,530 describes a multi-stage process for removing the metal and sulfur from residuum oils by reaction in the presence of hydrogen and a catalyst system. Catalysts are described as containing a Group VI and at least one Group VIII metal in sulfided condition, such as nickel-cobalt-molybdenum on alumina. Many catalyst combinations are described such as cobalt-molybdenum, nickel-tungsten and nickel-molybdenum. A non-cracking alumina support is mandatory for this multi-stage reaction. The aforementioned patents cite other U.S. patents having disclosures pertinent to the technology of removing metals and other contaminants, particularly sulfur and asphaltenes, from petroleum residuum.

However, it is a characteristic of the above-described processes that a fresh catalyst or a specialized catalyst is required or that the process suffers with respect to economic considerations in one aspect or another. While these processes are sufficient to accomplish the technical objective of removing metals from petroleum residuum, they are lacking in many respects in that they fail to utilize readily available and inexpensive catalyst materials while providing a tailor-made petroleum feedstock for a heavy oil catalytic cracking process.

U.S. Pat. No. 2,771,401 discloses a process in which spent fluid catalytic cracking catalyst is contacted wih petroleum feedstock to remove metals prior to charging the feed to a desulfurization unit.

U.S. Pat. No. 3,691,063 describes a hydrocracking process wherein a used fluid catalytic cracking catalyst is employed in a guard chamber to absorb metals and asphaltenes from a hydrocarbon residuum. The hydrocarbon feed from which the absorbed materials have been removed is then sent to a hydrocracker for processing and the the catalyst is regenerated by contact with steam and oxygen for return to the guard chamber.

A process for removing pentane insoluble asphaltenes and metals contained therein is described in U.S. Pat. No. 3,948,756 which involves a mild hydrogenation in the presence of a hydrogenation catalyst prior to a desulfurization step and further processing.

In view of the limited effectiveness of the above-described process, it is an object of this invention to provide an integrated heavy oil cracking process for the cracking of various petroleum feestocks which utilizes equilibrium catalyst withdrawn from the heavy oil cracking step itself in a pretreating zone integrally connected with the process for cracking the petroleum residuum. It is a further object of this invention to provide a process whereby petroleum with varying metals and carbon residue content can be processed in a heavy oil catalytic cracking unit. It is a further object of this invention to provide a heavy oil cracking process which provides a more efficient and flexible process for the processing of various petroleum feedstocks containing high metals and carbon residue.

It is yet a further important object of this invention to provide an integrated heavy oil cracking process which requires less catalyst makeup and a smaller regeneration zone for catalyst for a given petroleum feedstock containing metals and carbon residue.

SUMMARY OF THE INVENTION

This invention is an integrated catalytic cracking process for petroleum feedstock having at least about 5 ppm metals and a Ramsbottom carbon reside (ASTM D 524-64) of from about 2 wt. % to about 25 wt. %. A description of a current process used for the cracking of heavy oil is described in an article "Heavy-Oil Cracking Boosts Distillates", J. A. Finneran, J. R. Murphy and E. L. Whittington, *The Oil and Gas Journal,* Vol. 72, pp. 52–55, Jan. 14, 1974. In the described process, the products of the cracking reaction are disengaged from the catalyst in a disengaging zone and the catalyst is regenerated for further use in the cracking zone in a regenerating zone. In such a heavy oil cracking process, petroleum feedstocks are cracked to produce gasoline, distillates, and other valuable products. In the cracking of petroleum feedstocks, metals are deposited on the catalyst. These metals poison the catalyst and reduce the productivity of the cracking reaction and cause increased coke deposits on the catalyst which increases the load on the regeneration zone.

In order to have consistent operation, the metal content of the catalyst must be controlled. Such control is effected through continuous removal of the equilibrium catalyst from the process while continuously adding fresh makeup catalyst to the system. In this invention, the partially spent equilibrium catalyst withdrawn from the cracking process is used to provide an effective catalyst for a pretreating zone integrated with the catalytic cracker to contact the petroleum having a high metals and carbon residue content, in the presence of hydrogen, prior to charging this petroleum feedstock to the cracking zone.

In the practice of this invention, the catalyst, while preferably pelletized or extruded into discrete particles, may be used in its fluid (powder form) in a fluid bed or an ebullating bed. It is the practice of this invention to contact the incoming petroleum in the pretreating zone in the presence of a hydrogen, at a hydrogen partial pressure of from about 700 to about 3000 psig and at a temperature from about 750° F. to about 850° F. to effect metals and carbon removal from the feedstocks.

In the foregoing manner, metals are deposited on the pretreating zone catalyst so that the metals content of the petroleum feed is reduced to a usable level for charging to the cracking zone of the heavy oil cracker. Further, it has been found that the sulfur content of the petroleum feedstock is also advantageously reduced by the process of this invention. Thus, a cleaner petroleum feestock is charged to the catalytic cracking zone giving improved yields from that cracking zone, reduced carbon deposits on the catalyst to be regenerated, and savings on the catalyst necessarily charged to the heavy oil catalytic cracker to replace equilibrium catalyst withdrawn in order to maintain a tolerable level of metals contamination on the catalyst. With the present invention, a consistent feedstock for the catalytic cracking zone can be produced from crude streams with varying amounts of metal contamination and high carbon residue so that petroleum feedstocks, regardless of source, may be advantageously processed by a heavy oil cracking unit. In addition, the heavy oil cracking unit may employ smaller catalyst regenerating zones since much of the carbon residue can now be removed from the feedstock as a result of the pretreatment step.

DETAILED DESCRIPTION OF THE PREFERRED EMBODIMENTS

Figure 1:
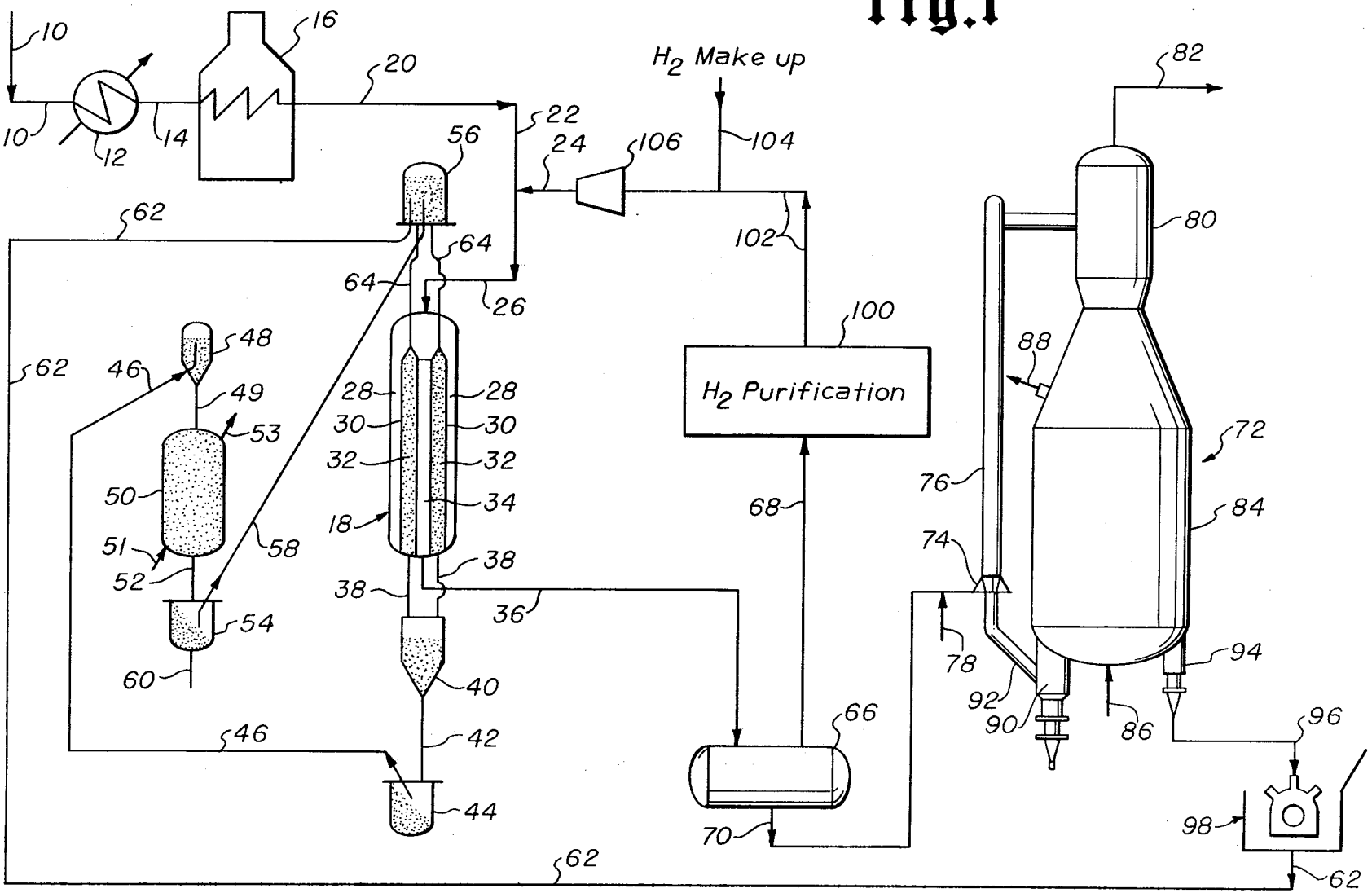
FIG. 1 is a schematic flow diagram showing the integrated heavy oil catalytic cracking process of this invention with common valves, fittings, gauges, and the like, omitted.

As stated above, the present invention is an integrated heavy oil catalytic cracking process which is particularly useful for converting heavy petroleum feedstocks containing substantial amounts of metals and carbon residue. Such feedstocks include fractions with initial boiling points in excess of about 400° F. The metals content of these feedstocks is more than about 5 ppm total vanadium and nickel, and it typically is on the order of 150 to 500 ppm total vanadium and nickel. In some cases, the metal content may be as high as about 700 or 800 ppm total vanadium and nickel. The carbon residue content of the feedstocks may be determined by the Ramsbottom Carbon Residue Test (ASTM D 524–64; IP 14/65), a test for determining the amount of carbon residue remaining after evaporation and pyrolysis of an oil. The Ramsbottom carbon residue content of the feedstocks converted by the process of the present invention may vary from about 2% by wt. to about 25% by wt.

Feedstocks which the present invention is particularly suited for converting include topped petroleum residua, either atmospheric or vacuum bottoms, heavy hydrocarbon fractions derived from deasphalting or other preliminary treatment, whole crude oils, or petroleum derived from coal, shale, or tar sands. Illustrative examples of specific feedstocks which may be used are Gach Saran atmospheric bottoms and Gach Saran vacuum residua. The Gach Saran atmospheric bottoms are known to contain from about 150 to 180 ppm total vanadium and nickel, 2.5 to 3 weight percent sulfur and approximately 8.5% by weight Ramsbottom carbon residue. The Gach Saran vacuum residua contain as much as about 500 ppm total vanadium and nickel.

With the present invention, the feedstocks are converted to gasoline, distillates, and other valuable products by a heavy oil cracking process, also known as the HOC Process. The HOC Process and its operation are well known to those skilled in the art and are described in U.S. Pat. No. 3,862,899 and the aforementioned article in the *Oil and Gas Journal,* both of which are incorporated herein by reference.

Two of the differences between the heavy oil cracking process and ordinary gas oil fluid catalytic cracking processes should, however, be specifically noted. First, the heavy oil cracking process handles feedstocks with much higher carbon residue contents than can be accommodated by gas oil FCC units. Second, the heavy oil cracking process handles feedstocks with much higher metals contents which, as explained in more detail below, have a significant effect on catalyst performance.

Conventional cracking catalysts are employed in the heavy oil cracking process. Such catalysts include, for example, amorphous silica-alumina catalysts and molecular sieve (zeolite) matrixtype catalysts having an average particle size in the range of about 40 to about 100 microns. Zeolite catalysts are preferred, but any of the known heavy oil cracking catalysts may be employed.

When the feedstock is cracked, these catalysts become contaminated with the metals in the feedstock. The metals are themselves catalysts for dehydrogenation reactions which tend to increase hydrogen and coke formation at the expense of light hydrocarbon product yields from the cracking zone. Thus, the metals on the catalyst detract from the desired cracking selectivity of the catalyst and, by causing excessive coke lay down, place undue loads on the regeneration zone of the process. In the HOC Process, to reduce the effect on the cracking process of the metals deposition, catalyst contaminated with metals is continuously removed from the cracking zone and fresh catalyst is added. This replacement of catalyst keeps the metals content in the cracking zone from becoming excessive and keeps the total amount of metals in the cracking zone at equilibrium. The metals level in the cracking zone remains at equilibrium when the weight of the metals on the catalyst removed equals the weight of the metals entering with the feedstock. The catalyst replacement rate in pounds per barrel is determined by the expression:

$$\text{catalyst replacement rate} = \frac{(\text{metals in feed, ppm})(\text{density of oil, \#/bbl})}{(\text{metals on catalyst, ppm})}$$

The catalyst withdrawn from the cracking zone to maintain equilibrium is known as equilibrium catalyst, and that term is used herein to define such catalyst. The equilibrium catalyst was usually discarded.

It has been discovered, however, that this normally discarded equilibrium catalyst is advantageously utilized in a pretreating zone integrated with the heavy oil cracking process to remove large portions of the metals from the feedstock. Usually, around 90 to 98 percent of the metals even with feedstock metal contents as high as 700 to 800 ppm total nickel and vanadium.

A first embodiment of the integrated heavy oil cracking process of the present invention is schematically depicted in FIG. 1. The petroleum feedstock enters through line 10 and usually passes through a heat exchanger 12 and thence through a line 14 to a preheat furnace 16. In the preheat furnace 16, the feedstock is heated to the temperature employed in a pretreating zone of reactor 18. The temperature of the pretreating zone is in the range of about 750° F. to about 850° F., but the temperature will, of course, vary according to the specific petroleum feedstock being processed. For example, Gach Saran atmospheric residuum is preferably heated to a temperature of from about 775° F. to about 825° F.

The preheated feedstock exits furnace 16 through a line 20 and is conveyed to a line 22 in which the feedstock is mixed with hydrogen entering through a line 24 at a sufficient pressure to provide the processing pressure in the pretreating zone as hereinafter described. The mixture of the feedstock and hydrogen is then conveyed through a line 26 to the pretreating zone reactor 18.

In the preferred embodiment of the present invention shown in FIG. 1, the pretreating zone reactor 18 is a conventional moving bed reactor. The mixture of feedstock and hydrogen introduced into reactor 18 initially flows downwardly and outwardly to the reactor fluid passageways 28 exterior to the plurality of perforated catalyst tubes 30 which support equilibrium catalyst 32 in a moving bed configuration. Subsequently, the mixture makes its principal contact with catalyst 32 by flowing through the catalyst tubes 30 and into the reactor's central fluid passageway 34. The treated feed then exits the pretreating zone reactor through line 36.

The catalyst 32 with which feed is contacted in the pretreating zone reactor 18 is equilibrium catalyst withdrawn from the heavy oil cracker with which the pretreating zone is integrated. As described in more detail below, the equilibrium catalyst is preferably pelletized or tableted after being withdrawn from the heavy oil cracker and then employed in the moving bed reactor 18.

During operation of the process of the present invention, the catalyst 32 utilized in reactor 18 is continuously circulated through the reactor and a regeneration unit outside the reactor 18 as is conventional with moving bed reactors. That is, catalyst is continuously withdrawn from the bottom of the reactor, circulated through a regeneration unit for regeneration of the catalyst and then readmitted to the reactor at the top of the reactor. As depicted in FIG. 1, catalyst is withdrawn from the bottom of catalyst tubes 30 through lines 38, and the withdrawn catalyst is temporarily collected in a lower reactor hopper 40. From the hopper 40, the catalyst is passed through a line 42 to a lift pot 44 which conveys the catalyst upwardly through line 46 to an upper regenerator hopper 48. The upper regenerator hopper 48 dispenses the catalyst through line 49 to a regenerator reactor 50. In the regenerator 50, the catalyst is contacted with an oxygen containing gas introduced through line 51 to burn off desired quantities of coke deposited on the catalyst in the pretreating zone. Flue gas exits reactor 50 through line 53. After regeneration, the catalyst is conveyed from reactor 50 through a line 52 and into a reactor lift pot 54. From reactor lift pot 54, the regenerated catalyst is conveyed upwardly to an upper reactor hopper 56 through 56 through line 58. The reactor lift pot 50 also has a discard valve 60 through which unwanted catalyst may be purged. However, the undiscarded catalyst in lift pot 54 is conveyed to upper reactor hopper 56. In addition, as explained in more detail below, catalyst withdrawn from the heavy oil cracker is preferably pelletized and conveyed through line 62 or other suitable conveying means to the upper reactor hopper 56. The catalyst in the upper hopper 56 is admitted to the upper portion of catalyst tubes 30 through lines 64.

The rate at which catalyst is circulated through pretreating reactor 18 and to the regenerator reactor 50 will vary according to the specific feedstock being processed. By way of example, however, it has been discovered that when Gach Saran atmospheric residuum is processed, the residence time of the catalyst in pretreating reactor 18 is preferably from about 2.5 days to 5 days when the feedstock is processed in reactor 18 at a liquid hourly space velocity of from about 0.15 Vo/hr/Vc (volume of oil/hr/volume of catalyst) to about 1.0 Vo/hr/Vc. After such time, the catalyst is preferably regenerated. With Gach Saran atmospheric residuum being processed at a space velocity of 0.15 to 1.0 Vo/hr/Vc, the catalyst is preferably discarded through purge valve 60 after about 35 to about 60 days of contacting oil.

In the pretreating reactor 18, the feedstock mixed with hydrogen contacts the equilibrium catalyst 32 at mild hydrocracking conditions, namely, at a temperature of from about 750° F. to about 850° F., at a hydrogen partial pressure of from about 700 psig to about 3000 psig, preferably from about 800 psig to about 1000 psig, and at a liquid hourly flow rate of from about 0.15 Vo/hr/Vc to about 1.0 Vo/hr/Vc.

It has been found that pretreating the petroleum feedstock at the above mentioned conditions gives excellent removal of vanadium and nickel. Usually, removal of these heavy metals is on the order of 90 to 98 percent. While talking in terms of removing nickel and vanadium, it should be understood that other metals, such as iron, copper, and the like, present in minor amounts are also removed. Further, significant amounts of carbon residue and sulfur are removed by the pretreating step of the present invention.

The effluent of the pretreating zone is passed through line 36 to a flash tank 66. In the flash tank, hydrogen and any hydrogen sulfide formed in the pretreating zone are removed from the effluent. The removed hydrogen and hydrogen sulfide are conveyed through line 68 to a conventional purification unit 100. In the purification unit 100, hydrogen is separated from sulfur containing materials with a suitable scrubbing solution such as an amine, monoethanolamine, diethanolamine, or the like. The hydrogen thus separated is relatively pure recycle hydrogen which exits the purification unit 100 through line 102. In line 102, fresh make up hydrogen from a suitable source (not shown) is added through line 104. The hydrogen conveyed in line 102 is then supplied to a compressor 106. The compressor 106 brings the hydrogen to a pressure suitable for use in the pretreating zone and supplies the pressurized hydrogen to line 24 for mixing with feedstock in line 22 as previously described.

The liquid portion of the pretreating zone effluent is removed from flash tank 66 through a line 70. This liquid effluent forms the feedstock for the heavy oil cracking step of the present invention. Line 70 conveys this treated feedstock to the heavy oil cracking unit, designated generally by the numeral 72.

The pretreated feedstock enters the heavy oil cracking unit 72 through a feed line 74 which is in fluid communication with a riser 76. The riser 76 contains fluidized cracking catalyst moving upwardly and is the principal cracking zone. Prior to introduction into the cracking zone, the feedstock entering through line 74 is dispersed with steam entering through line 78 to ensure that adequate contact is made with the fluidized catalyst moving upwardly through the riser 76.

Cracking severity is controlled to provide the desired feedstock conversion, usually at least 65 volume percent and preferably between 80 and 100 percent. Typical cracking conditions are set forth below in Table I:

TABLE I

CATALYTIC CRACKING CONDITIONS

| | Broad | Preferred |
|---|---|---|
| Riser Outlet Temperature, F° | 850–1200 | 1000 |
| Pressure, psig | 10–50 | 30 |
| Recycle Rate, Vol % (FF) | 0–100 | 15 |
| Catalyst/Oil Ratio | 3/1–15/1 | 6/1 |
| Space Velocity, wt/hr/wt | 0.5–1000 | 200 |

A riser cracking unit such as is useful in this integrated process is shown and described in U.S. Pat. No. 3,607,127, issued Sept. 21, 1971. The riser 76 should have a length to diameter ratio in the range of 3/1 to 30/1. From 50 to 95 percent of the cracking reaction takes place in the riser 76 and the remainder of the cracking takes place in the disengaging zone 80 and the stripper (not shown). Cracked materials leaving the end of the riser 76 disengage from the catalyst in zone 80 and pass upwardly through cyclones (not shown) for recovery and exit the unit through line 82. Catalyst and occluded hydrocarbons pass downward through the disengaging zone to the stripper which is fitted with suitable baffle means and a steam ring adapted to strip occluded cracked effluent which passes overhead while the catalyst passes downwardly into the regeneration zone 84. In the regeneration zone 84, the catalyst is contacted with an oxygen containing gas entering through line 86 at regeneration temperatures whereby the coke on the catalyst is burned off to the desired levels of residual coke on the regenerated cracking catalyst. Within the regenerating zone 84 are steam coils (not shown) adapted to remove heat from the catalyst. The gaseous products in the regeneration zone 84 are separated in an internal cyclone to remove any solids, allowing a flue gas to be removed through line 88. The regenerated catalyst passes through plug valve 90 and conduit 92 wherein it is again introduced into the cracking zone in the riser 76. The aforementioned U.S. Pat. No. 3,862,899 and the *Oil and Gas Journal* article describe further aspects of the heavy oil cracking and regeneration zones, the specific details of which do not form a part of this invention.

Equilibrium catalyst is withdrawn from the regenerator 84 through plug valve 94 and thence conducted through line 96 to a pelletizer 98 where it is placed in pellet form for use in the improved process of this invention. The pelleted catalyst is conveyed through line 62 or other suitable conveying means to the upper reactor hopper 56 from which it can be dispensed to pretreating reactor 18 for contacting feedstock in the pretreating zone. For purposes of convenience and description of a preferred embodiment, pelletizer 98 is depicted in FIG. 1. It should be understood, however, that the equilibrium catalyst may be used in fluid form in an ebullating reactor or extruded with a suitable binder for use in an extruded form or pelletized or tableted in suitable pretreating reactors.

Figure 2:
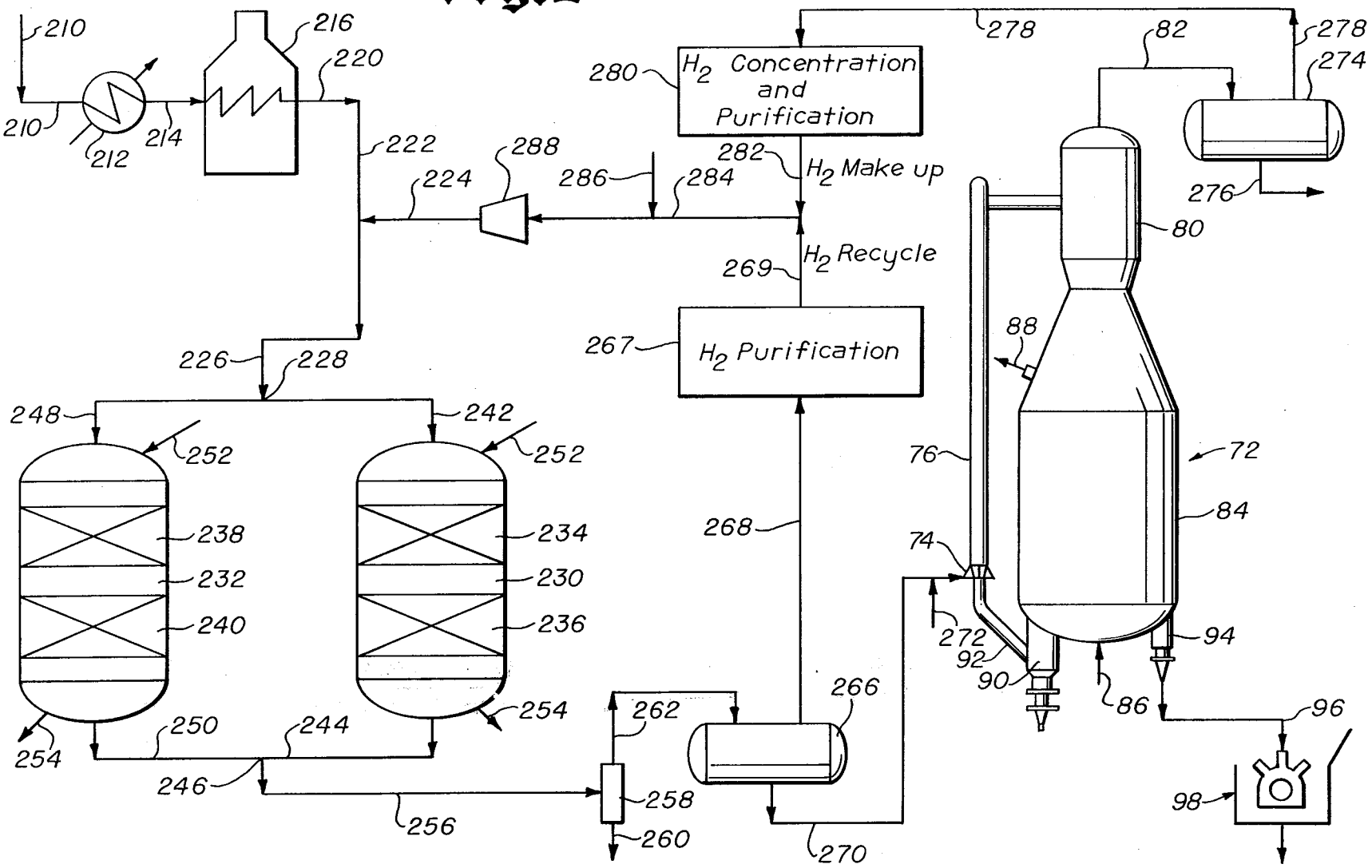
FIG. 2 is a schematic flow diagram showing an alternate configuration when fixed bed pretreating zones are employed in the integrated process of this invention.

FIG. 2 schematically illustrates a second embodiment of the present invention in which pellitized or tableted equilibrium catalyst from the heavy oil cracking unit is employed in fixed bed reactors to pretreat the feedstock. In addition, other important features of the process of the present invention are shown and described with the second embodiment.

Referring to FIG. 2, feedstock enters the integrated heavy oil cracking system through line 210 and usually passes through a heat exchanger 212. From the heat exchanger 212, the feedstock flows through a line 214 to a preheat furnace 216 in which the feedstock is heated to the temperature employed in the pretreating zone, namely, from about 750° F. to about 850° F., depending upon the specific feedstock being processed.

The heated feedstock exits furnace 216 through line 220 and is conveyed to line 222 in which the feedstock is mixed with hydrogen entering through line 224 at a pressure sufficient to provide the processing pressure in th pretreating zone. The mixture of feedstock and hydrogen is then conveyed through line 226 to a header 228 for controlling flow of the mixture to the pretreating zone.

To provide the pretreating zone, the second embodiment of the present invention includes a pair of fixed bed reactors 230 and 232, each of which is depicted as having two fixed catalyst beds 234, 236, and 238, 240, respectively, of equilibrium catalyst withdrawn from the heavy oil cracking zone of the present invention.

The reactors 230 and 232 are operable as cyclic duty or swing reactors. That is, the reactors are alternately in an operating mode and a catalyst regeneration mode. This type of reactor operation is well known in the art. Suffice it to say that when reactor 232 in the regeneration mode, header 228 directs flow of feedstock from line 226 through line 242, through reactor 230 where the feed contacts equilibrium catalyst in beds 234 and 236, and out of reactor 230 through line 244 to header 246. Flow to reactor 232 through lines 248 and 250 is blocked by headers 228 and 246. Conversely, when reactor 232 is in the operating mode and reactor 230 in the regeneration mode, flow is directed through lines 248, reactor 232, and line 250 to header 246, and flow to reactor 230 through lines 242 and 246 is blocked by the headers.

It will be appreciated, therefore, that when one of the reactors is in the regeneration mode, it is effectively isolated from the flow path of the process so that regeneration of the catalyst in that reactor can be carried out. Such regeneration can be accomplished by introducing through line 252 an oxygen-containing gas, such as air, which passes over the catalyst to burn carbon off the catalyst. Products of the combustion may be exhausted from the reactor through line 254 and disposed of in an environmentally acceptable manner. The frequency of regeneration is substantially the same as that previously discussed with reference to regeneration of catalyst in reactor 18 of the first embodiment of this invention. The frequency of discarding catalyst used in the reactors is also substantially the same as that discussed earlier with reference to the pretreating zone of the first embodiment. Replacement of catalyst in either of the reactors 230 or 232 is carried out when the reactor is in the regeneration mode. The reactor is shut down, catalyst in the reactor is dumped, and replacement equilibrium catalyst withdrawn from the heavy oil cracking process of the present invention is added to the reactor.

The reactor in the operating mode receives petroleum feedstock and hydrogen from line 226. As the feedstock flows through the reactor, it contacts the equilibrium catalyst in the reactor's fixed beds. The conditions in the operating mode reactor are maintained at mild hydrocracking conditions, namely, a temperature of from about 750° F. to about 850° F., and a hydrogen partial pressure of from about 700 psig to about 3000 psig, preferably from about 800 psig to about 1000 psig. The liquid hourly flow rate is from about 0.15 Vo/hr/Vc to about 1.0 Vo/hr/Vc.

It has been discovered that the pretreating step is very effective in removing heavy metals, principally vanadium and nickel, which are present in the feedstock as porphyrins, porphyrin-metal complexes, and other forms. Typically, removal of from about 90 to 98% of these heavy metals can be achieved with pretreating step of the present invention. In addition, sulfur removal on the order of about 50% is achieved with the pretreating step.

As shown in FIG. 2, a separation of asphaltenes can be accomplished by passing the effluent of the pretreating zone through line 256 to a separator 258. The separation of asphaltenes in separator 258 may be accomplished in any suitable manner. The asphaltenes exit separator 258 through line 260, and the remaining effluent, now greatly reduced in metals and carbon residue content is passed through a line 262 to a flash tank 266.

Referring again to FIG. 2, feedstock is conveyed through line 262 to flash tank 266, and hydrogen and hydrogen sulfide formed in the pretreating zone are withdrawn through line 268. Line 268 conveys the hydrogen and hydrogen sulfide to a conventional purification unit 267. In the purification unit 267, hydrogen is separated from sulfur compounds with a suitable scrubbing solution such as an amine, monoethanolamine, diethanolamine, or the like. The hydrogen thus separated is a relatively pure recycle hydrogen which exits the purification unit 267 through a line 269.

The liquid portion of the effluent in the flash tank 266 is withdrawn through line 270 and forms the feedstock for the heavy oil cracking step of the present invention. The feedstock in line 270 is dispersed with steam introduced through line 272 and fed to the heavy oil cracking unit.

The heavy oil cracking unit utilized in the second embodiment of the present invention is identical in all respects to the heavy oil cracking unit employed in the first embodiment of the present invention. Accordingly, like numerals are used in FIGS. 1 and 2 to designate like elements of the heavy oil cracking unit. Further, the process conditions of the heavy oil cracking step of the second embodiment are identical to the process conditions of the heavy oil cracking step of the first embodiment, and the above discussion of the heavy oil cracking step of the first embodiment is incorporated here by reference as applicable to the heavy oil cracking step of the second embodiment of the present invention.

It is specifically noted, however, that equilibrium catalyst is withdrawn from regenerator 84 of the heavy oil cracker 72 through a plug valve 94. From the plug valve 94, the withdrawn catalyst is passed through line 96 to pelletizer 98. The equilibrium catalyst is pelletized or tableted by the pelletizer 98. With the second embodiment of the present invention, the pelletized catalyst is stored in a bin or other suitable receptacle so that it is available as replacement catalyst to replace catalyst discarded from reactors 230 or 232.

Also, in the second embodiment of the present invention, the effluent of the heavy oil cracking unit 72 is conveyed through line 82 to a flash tank 274. The liquid portion of the effluent in flash tank 274 is the final product of the integrated heavy oil conversion of the present invention and this product is withdrawn from flash tank 274 through line 276.

The gaseous portion of the effluent in flash tank 274 is withdrawn through line 278 and is conveyed to a conventional hydrogen concentration and purification unit 280. In the hydrogen concentration and purification unit, hydrogen and hydrogen sulfide are separated from other gaseous effluents from flash tank 274 and hydrogen is separated from sulfur with a suitable scrubbing solution so that relatively pure hydrogen can be withdrawn from unit 280 through line 282. The hydrogen from line 282 is used as make up hydrogen for the pretreating zone. The make up hydrogen from line 282 is combined with recycle hydrogen from line 269 in line 284. If desired, further make up hydrogen from an external source (not shown) may be admitted to line 284 through line 286. In either event, however, the make up and recycle hydrogen are supplied through line 284 to a compressor 288 which compresses the hydrogen to the desired pressure for mixing with feedstock in line 222 as described above.

It will be appreciated, of course, that the above described embodiments are illustrative, and modifications of the described embodiments are possible without departing from the spirit or scope of the present invention. For example, three sources of hydrogen for the pretreating zone have been discussed: recycle hydrogen from the effluent of the pretreating zone, make up hydrogen from the heavy oil cracking zone effluent, and make up hydrogen from an external source. Without departing from the scope of the present invention, any combination of these three sources of hydrogen may be employed to supply hydrogen to the pretreating zone. Further, by way of example, two or more pretreating zones may be employed in series to treat the feedstock prior to changing it to the heavy oil cracking unit. The use of a plurality of pretreating zones in series may be desired where the feedstock being processed has extremely high metals or carbon residue content.

The practice of the process of this invention will be further exemplified by the following Example which is provided for purpose of illustration and not limitation.

EXAMPLE

To demonstrate operation of the pretreatment step of the integrated heavy oil cracking process of this invention, Gach Saran atmospheric bottoms were selected as the petroleum residuum for processing. This feed is selected because of its substantial metals content which would cause abnormal operation of the heavy oil catalytic cracking process. The properties of this petroleum residuum are shown in Table II.

TABLE II

| Property | Gach Saran Atmospheric Bottoms |
|---|---|
| Gravity, °API | 16.0 |
| Gravity, SpG 60° F/60° F | 0.960 |
| Flash Point, ° F | 264 |
| Viscosity, CS 122° F | 290.5 |
| Viscosity, CS 210° F | 29.3 |
| Con Carbon, Wt % | 9.4 |
| Asphaltenes (n-$C_7$), Wt % | 3.0 |
| Asphaltenes (n-C5), Wt % | 6 |
| Sulfur, Wt % | 2.60 |
| Nitrogen (Total), Wt % | 0.38 |
| Nitrogen (Basic), Wt % | 0.10 |
| Metals, ppm | |
| Vanadium | 123 |
| Nickel | 43 |

The experiments of this Example were run in a one-inch I.D. (2.54 cm) Schedule 80 reactor mounted vertically in a furnace to provide for external heating. The reactor has an actual measured inside diameter of 0.957 inches and interior cross-sectional area of 0.715 square inches. Thermocouples were provided for measuring the temperature of the catalyst bed. Facilities were attached to the reactor for pumping liquid and for metering hydrogen at 1,000 psig, and a two- stage separator system was employed to collect liquid product with product gas being metered and sampled before disposal. Steam tracing of lines was employed to permit feeding and collecting the petroleum residuum used as a feedstock because of the very viscous nature of the material.

The catalyst employed in the experiment was prepared by pelletizing a sample of a natural equilibrium fluid catalytic cracking catalyst which had been in service in a commercial heavy oil cracking unit. The catalyst pellet size was one eighth inch and had a carbon content of 6.4 wt. %. The catalyst had been tested previously at 700° F. with only minor removal of metals. The data concerning metal removal from the previous test and startup on this aging test are shown in Table III.

TABLE III

| | Time on Oil Total Hours | Metals Removal, % Vanadium | Nickel |
|---|---|---|---|
| Past | 15 | 73 | 53 |
| Operation | 33 | 56 | 23 |
| | 51 | 49 | Nil |
| Present Test | 63 | 63 | 40 |
| Startup | 69 | 41 | 19 |

Aging Test

Shortly after startup at 700° F., the temperature was raised to 800° F., the reactor hydrogen partial pressure set at 900 psig, hydrogen rate at 4400 scf/Bbl with a liquid space velocity of 0.25 Vo/hr/Vc. The test was run for approximately 250 hours which, with the 70 hours of the original test, totalled 320 hours of exposure of the catalyst to the residuum oil. Table IV below shows the operating data and results of this aging test.

TABLE IV

AGING OF PELLETED HEAVY OIL CRACKING CATALYST

| TIME ON OIL, HOURS | 21 | 33 | 60 | 75 | 102 | 113 | 136 | 160 | 180 | 210 | 216 | 227 | 239 |
|---|---|---|---|---|---|---|---|---|---|---|---|---|---|
| OPERATING CONDITIONS | | | | | | | | | | | | | |
| Reactor Temp., ° F. | 800 | 800 | 800 | 800 | 800 | 800 | 800 | 800 | 800 | 800 | 800 | 800 | 800 |
| Reactor Pressure, psig | 900 | 900 | 900 | 900 | 850 | 850 | 850 | 850 | 850 | 850 | 850 | 850 | 850 |
| Oil Rate, g/hr[1] | 44.8 | 46.8 | 48.2 | 46.5 | 44.3 | | 51.2 | 54.0 | 51.2 | 45.8 | 40.8 | 48.3 | 45.7 |
| $H_2$ Rate, SCFH (Ave. $H_2$=4774 SCF/BBL) | 1.417 | 1.428 | 1.463 | 1.484 | 1.484 | | 1.497 | 1.497 | 1.463 | 1.497 | 1.504 | 1.497 | 1.490 |
| PRODUCTS | | | | | | | | | | | | | |

TABLE IV-continued

AGING OF PELLETED HEAVY OIL CRACKING CATALYST

| | | | | | | | | | | | | | |
|---|---|---|---|---|---|---|---|---|---|---|---|---|---|
| Liquid Prod Analysis[2] | | | | | | | | | | | | | |
| Vanadium, ppm | 3 | 6 | — | 19 | 15 | 20.5 | 29 | 47 | 53.5 | — | 40 | — | 44 |
| Nickel, ppm | 9 | 8 | — | 12.5 | 11 | 14 | 19 | 25 | 22.5 | — | 19.5 | — | 22 |
| Sulfur, ppm | 2.10 | 1.73 | — | 2.02 | 1.88 | 2.02 | 2.10 | 2.22 | 2.03 | — | 2.10 | — | 2.14 |
| Con Carb. Res., Wt % | — | — | — | 4.99 | — | — | 5.44 | — | 6.28 | — | — | — | 6.23 |
| Product Gas, SCFH | 1.343 | 1.351 | 1.409 | 1.418 | 1.414 | | 1.433 | 1.433 | 1.385 | 1.408 | 1.395 | 1.407 | 1.414 |
| Product Gas Analysis | | | | | | | | | | | | | |
| $H_2$ Content, Mole % | 96.0 | 96.1 | 97.0 | 96.3 | 97.0 | 97.2 | 97.3 | 96.9 | 97.0 | 97.0 | 96.2 | 97.2 | 97.3 |
| Molecular Weight | 3.29 | 3.28 | 3.01 | 3.32 | 3.02 | 2.99 | 2.90 | 3.01 | 3.03 | — | 3.48 | 2.97 | 2.89 |
| CALCULATED RESULTS | | | | | | | | | | | | | |
| $H_2$ Consumed, SCFB | 436 | 423 | 304 | 387 | 386 | — | 307 | 305 | 358 | 435 | 606 | 407 | 380 |
| HC in Gas, Wt % | 4.9 | 4.7 | 3.7 | 5.0 | 4.1 | — | 3.1 | 3.4 | 3.5 | — | 6.3 | 3.5 | 3.5 |
| F.F.[3] | | | | | | | | | | | | | |
| Vanadium Removal, % | 97.6 | 95.1 | — | 84.6 | 87.8 | 83.3 | 76.4 | 61.8 | 56.5 | — | 67.5 | — | 64.2 |
| Nickel Removal, % | 79.1 | 81.4 | — | 70.9 | 74.4 | 67.4 | 55.8 | 41.9 | 47.7 | — | 54.7 | — | 48.8 |
| Sulfur Removal, % | 26.8 | 39.7 | — | 29.6 | 34.5 | 29.6 | 26.8 | 22.6 | 29.3 | — | 26.8 | — | 25.4 |
| Con Carbon Removal, % | — | — | — | 46.9 | — | — | 42.1 | — | 33.2 | — | — | — | 33.7 |

| CATALYST INSPECTIONS | CAT TOP | CAT MID | CAT BTM | AVERAGE |
|---|---|---|---|---|
| Vanadium, Wt % | 0.99 | 0.96 | 0.86 | 0.94 |
| Nickel, Wt % | 0.48 | 0.51 | 0.49 | 0.49 |
| Carbon, Wt % | 8.1 | 11.4 | 18.8 | 12.8 |

[1] Total oil feed for run - 12103 grams = (45.7 g/hr ave.) )
[2] Total liquid product for run = 11694 grams ) 100.7 Wt Balance
[3] Average hydrocarbon in gas = 4.1 wt % feed = 496 grams total)

It is to be noted that after only 75 hours of operation, the total metals content of the product exiting the pretreating zone which would represent the feed to the heavy oil catalytic cracking unit cracking zone is greater than 20 ppm. Thus, while the percentage removal of vanadium and nickel are high, 84.6% and 70.9% respectively, the metals content of the petroleum residuum was still at a high level. Throughout the aging test, the metals removal dropped off continuously. After this aging test was complete, the catalyst was removed from the reactor and analyzed. A comparison of the metal content with respect to the catalyst is shown in Table V.

TABLE V

METALS ON CATALYST

| | On equilibrium catalyst from cracking process | After initial test (start aging) | At end of aging test |
|---|---|---|---|
| Nickel, Wt. % | 0.33 | 0.35 | 0.49 |
| Vanadium, Wt. % | 0.53 | 0.62 | 0.94 |

At the end of the aging test, 8.8 barrels of feed had been processed per cubic foot of catalyst and the processed residuum contained a total of 74 ppm metals (nickel plus vanadium), which would generally be too high a level for a feed to a catalytic heavy oil cracking unit utilizing present technology because it would necessitate an unacceptably high rate of catalyst replacement. For the total test, hydrogen consumption averaged 385 scf/bbl for this test. Desulfurization also occurred during the aging test, but the the sulfur removal declined from about 40% to about 20%.

Catalyst Regeneration

The catalyst withdrawn from the pretreatment reactor was placed in a one-inch diameter quartz tube in a vertical heating furnace and heated to 1100° F. while passing a stream of nitrogen over the catalyst. The oxygen content of the nitrogen gas was gradually increased until the oxygen and nitrogen proportions were the same as in air. The heating was continued very carefully to remove carbon from the catalyst surface. The heating was continued until the catalyst had a residual carbon content of 0.2 wt. %. The surface area of the catalyst was analysed at 54 square meters per gram. The catalyst was then recharged to the reactor in a catalyst pack as follows: the bottoms were aluminum quarter rings 2 inches deep (23 gms), alumina chips on a 6-mesh screen 7 inches deep (134 gms), the catalyst pellets were placed in a bed 8 inches deep (85 gms) and on top was placed 11 inches of alumina 3/16 × 3/16 inches pellets (208 gms). Substantially the same catalyst bed arrangement was used throughout this example and the information of catalyst inspection is set forth in Table VII.

TABLE VI

LIQUID PRODUCT INSPECTIONS

| | | ← I → | | | | | | ← II → | | | | ← III → | | | ← IV → | | | |
|---|---|---|---|---|---|---|---|---|---|---|---|---|---|---|---|---|---|---|
| Run No. | | R* | | | | | | R* | | | | | | | | | | |
| Time Period No. (Each 8-Hr) | | 2 | 5 | 7 | 8 | 9 | 10 | 2 | 3 | 5 | 7 | 2 | 3 | 3 | 6 | 10 | 12 | 14 |
| Total Treating Hours | | 337 | 361 | 377 | 385 | 393 | 401 | 417 | 425 | 441 | 457 | 473 | 481 | 505 | 529 | 561 | 577 | 593 |
| Hours Since Regeneration | | 12 | 36 | 52 | 60 | 68 | 76 | 12 | 20 | 36 | 52 | 68 | 76 | 100 | 124 | 156 | 172 | 188 |
| Liquid Product Inspections | Oil Feed | | | | | | | | | | | | | | | | | |
| Nickel - ppm | 37 | 1 | 1.1 | 8 | 4 | <1 | 3 | <1 | 1 | 1.7 | 1 | 12 | 4 | 3 | 5 | 3 | 2 | (139) |
| Vanadium | 123 | <1 | <1 | <1 | 2 | 1.2 | 1 | <1 | <1 | 1.1 | <1 | 7 | 12 | <1 | 5 | 4 | <1 | 2 |
| Sulfur | 2.9 | 0.8 | 1.4 | 0.5 | 0.9 | 1.2 | 1.5 | 1.5 | 1.5 | 1.5 | 1.6 | 1.9 | 1.8 | 1.8 | 2.0 | 1.9 | 1.9 | 2.0 |
| Carbon Residue % | 9.4 | — | 1.3 | — | — | 0.4 | — | 0.6 | — | — | 2.3 | 3.7 | — | 2.1 | — | — | 3.0 | — |
| % Removal (At 100% Liquid Product) | | | | | | | | | | | | | | | | | | |
| Nickel | | 97 | 97 | 78 | 89 | 97+ | 92 | 97+ | 97+ | 95 | 97 | 68 | 89 | 92 | 86 | 92 | 95 | |

TABLE VI-continued

| | LIQUID PRODUCT INSPECTIONS | | | | | | | | | | | | | | | | |
|---|---|---|---|---|---|---|---|---|---|---|---|---|---|---|---|---|---|
| | ← I → | | | | | | ← II → | | | ← III → | | | ← IV → | | | | |
| Run No. | R* | | | | | | R* | | | | | | | | | | |
| Vanadium | 99+ | 99+ | 99+ | 98 | 99 | 99 | 99+ | 99+ | 99 | 99+ | 94 | 90 | 99+ | 96 | 97 | 99+ | 98 |
| Sulfur | 72 | 52 | 83 | 69 | 59 | 48 | 48 | 48 | 48 | 45 | 34 | 38 | 38 | 31 | 34 | 34 | 31 |
| Carbon Residue | — | 86 | — | — | 96 | — | 93 | — | — | 76 | 61 | — | 78 | — | — | 68 | — |

*Catalyst Regenerated

TABLE VII

| | Catalyst Inspection | | | | | | | | | | | | |
|---|---|---|---|---|---|---|---|---|---|---|---|---|---|
| | ← I → | | | ← II → | | | | ← III → | | ← IV → | | | |
| Run No. | R* | | | R* | | | | | | | | | |
| | | in gm | gm | in gm | gm | in gm | gm | in gm | gm | in gm | gm | gm | gm |
| Reactor Catalyst Charge | | 8 85 | 98 | 8 80 | 94 | 7+ 93 | 92 | 7+ 92 | 89 | 7+ 89 | 89 | 89 | 88 |
| Fines (Dumped) 8 grams | | | — | | — | | — | | — | | 12 | | (6) 4 |
| Charge or Dump | D | C | D | C | D | | D | | D | | D | | D |
| Date - 1975 | 3-7 (3) | 10-20 | 11-5 | 11-7 | 11-10 | | 11-13 | | 11-17 | | 12-1 | | 12-7 |
| Results-As Sampled | | | | | | | | | | | | | |
| Nickel % | 0.49 | — | — | 0.53 | — | | — | | — | | — | | — |
| Vanadium | 0.94 | — | — | 1.09 | — | | — | | — | | — | | |
| Carbon | 14 | 0.2 | 14 | 0.2 | 9.4 | | 14/13 | | — | | — | | 14/13 |
| Surface - Sm/Gm | 5 | 54 | 6 | 56 | — | | -/5 | | | | | | 1 |

*Catalyst Regenerated

Continued Runs With Regenerated Catalyst

The Gach Saran atmospheric bottoms were charged to the reactor at a liquid space velocity of 0.2 Vo/hr/Vc. The reactor was operated at a temperature of about 800° F. and under a partial pressure of hydrogen of about 850 psig. The results of a series of runs are tabulated on Tables VI and VII showing the analytical results for four runs at the previously set forth conditions. The catalyst was regenerated between runs I and II and the exemplary removal of nickel and vanadium from the petroleum residuum was restored by such regeneration. On Table VII it is indicated the metal contamination removed by the presence of the catalyst in the operation of the pretreating zone in accordance with the practice of this invention. It should be noted that the liquid product resulting from an oil feed which originally contained 37 ppm nickel and 123 ppm vanadium and 2.9 percent sulfur could be charged to a fluidized heavy oil cracking unit at a very low metals content.

Figure 3:
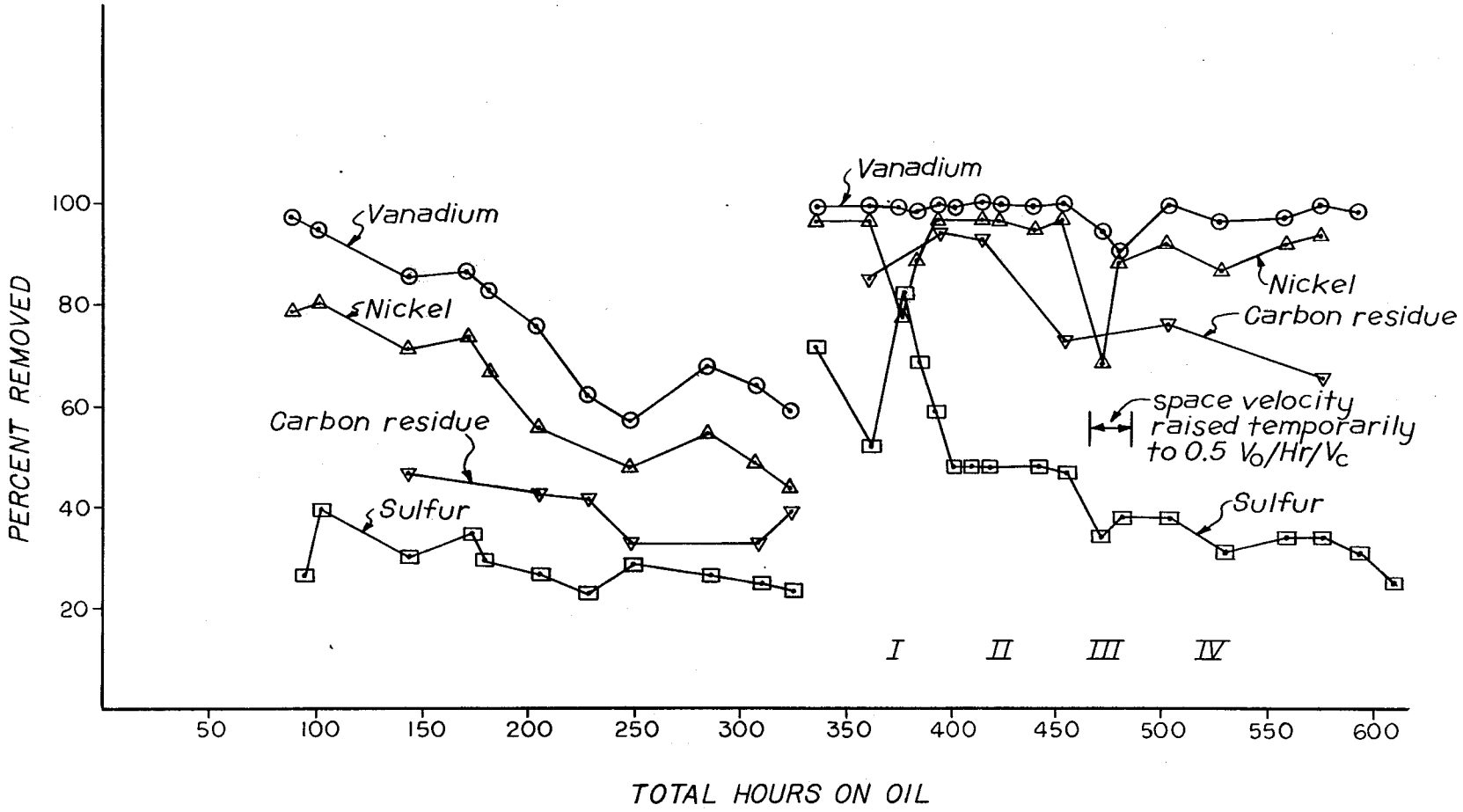
FIG. 3 is a graph showing the results of the experiment described in Example 1 hereof and is representative of the results achieved in the pretreating step of the integrated process of this invention.

Further, it is graphically demonstrated on FIG. 3 and can be seen Table VI that an increase in the liquid volume space velocity to 0.5 Vo/hr/Vc materially reduced the metals removal from the petroleum residuum.

Further inspection of the catalyst periodically dumped from the reactor, whether or not regeneration occurred prior to such dumping, indicates that the presence of carbon on the catalyst surface had little effect upon the removal of metals from the petroleum residuum charged.

Additional experiments were run in like manner to investigate the variables of temperature and liquid hourly space velocity. The results of these runs indicated that the space velocity preferred for the practice of this invention is from about 0.15 Vo/hr/Vc to about 0.5 Vo/hr/Vc. At temperatures of about 850° F. the feed caused extensive coking in the reactor, and at temperatures lower than about 750° F. unsatisfactory metal removal from the feed resulted, indicating that the preferred temperature range for the practice of this invention is from about 750° F. to about 850° F. Within this temperature range, excellent metals removal was obtained.

The foregoing Example illustrates the effectiveness of the integration of the pretreatment zone and the heavy oil cracking unit into the unitary process of this invention and are offered for purposes of illustration and not limitation. One of ordinary skill in the art considering the foregoing description of this invention would be led to many modifications thereof without departing from the scope and intent of the appended claims hereto.

I claim as my invention:

1. An integrated heavy oil cracking process for catalytically cracking a petroleum feedstock containing at least about 5 ppm metals and having a Ramsbottom carbon residue of from about 2 weight percent to about 25 weight percent comprising the steps of:

a. contacting the feedstock in a pretreating zone in the presence of 700 to 3000 psig partial pressure of hydrogen at a temperature from about 750° F. to about 850° F. with equilibrium catalyst withdrawn from a heavy oil cracking unit;

b. separating the treated feedstock from the equilibrium catalyst;

c. feeding the separated, treated feedstock of step (b) to a fluid catalytic cracking zone of a heavy oil cracking unit in the presence of a fluid cracking catalyst to produce a cracked effluent; and d. withdrawing equilibrium catalyst from the heavy oil cracking unit for use in the pretreating zone of step (a).

2. The integrated heavy oil cracking process of claim 1 wherein the equilibrium catalyst used in the pretreating zone is regenerated by contacting the catalyst at elevated temperatures with an oxygen-containing gas for a time sufficient to reduce the carbon content of the catalyst; and returning the regenerated catalyst to the pretreating zone.

3. The process of claim 1 wherein the equilibrium catalyst withdrawn in step (d) from the cracking process is pelletized prior to use in the pretreating zone.

4. The process of claim 3 wherein the pelletized catalyst is circulated in a moving bed reactor in step (a).

5. The process of claim 4 wherein a plurality of moving bed reactors are used.

6. The process of claim 4 wherein portions of the pelletized catalyst from said pretreating zone are continuously removed from the bottom of the bed of the reactor and regenerated catalyst is added to the top of the bed.

7. The process of claim 1 wherein the feedstock and hydrogen are mixed prior to entry into the pretreating zone.

8. The process of claim 7 wherein the hourly liquid space velocity of the feedstock through said equilibrium catalyst is from about 0.15 to about 1.0 Vo/hr/Vc.

9. The process of claim 6 wherein portions of catalyst are continuously purged from said equilibrium catalyst removed from the pretreating zone and pelletized equilibrium catalyst withdrawn from the cracking unit of step (d) is added to the pretreating zone in amounts such that the pelletized catalyst is used in the pretreating zone for about 35 to about 60 days.

10. The integrated heavy oil cracking process of claim 1 wherein the treated feedstock of step (b) is separated from asphaltenes prior to feeding the feedstock to the fluid catalytic cracking zone of the heavy oil cracking unit.

11. The process of claim 3 wherein the feedstock contacts the pelletized equilibrium catalyst in step (a) in a fixed bed reactor.

12. The process of claim 11 wherein a plurality of fixed bed reactors are used.

13. The integrated heavy oil cracking process of claim 1 further including prior to step (c):

removing hydrogen from the effluent of the pretreating zone; and utilizing at least a portion of the removed hydrogen as at least a portion of the hydrogen for step (a).

14. The integrated heavy oil cracking process of claim 1 wherein the catalytic cracking zone of the heavy oil cracking unit produces hydrogen, and further including:

utilizing at least a portion of the hydrogen from the catalytic cracking zone of the heavy oil cracking unit as at least a portion of the hydrogen for step (a).

15. The integrated oil cracking process of claim 1 wherein hydrogen is consumed in the pretreating zone at a rate from about 300 standard cubic feet hydrogen per barrel of feedstock to about 450 standard cubic feet hydrogen per barrel of feedstock.

16. The integrated heavy oil cracking process of claim 1 wherein the temperature of step (a) is from about 775° F. to about 825° F.

17. The integrated heavy oil cracking process of claim 1 wherein the hydrogen partial pressure of step (a) is from about 800 to about 1000 psig.

* * * * *